United States Patent [19]

Engdahl, Jr.

[11] Patent Number: 4,782,944

[45] Date of Patent: Nov. 8, 1988

[54] MULTI-CELLULAR CARRIER

[75] Inventor: Arnold B. Engdahl, Jr., Irwin, Calif.

[73] Assignee: Federal Paper Board, Inc., Montvale, N.J.

[21] Appl. No.: 24,761

[22] Filed: Mar. 11, 1987

[51] Int. Cl.[4] ..... B65D 5/46; B65D 5/48

[52] U.S. Cl. ..... 206/185; 206/170; 206/173; 206/186; 206/190

[58] Field of Search ..... 206/170–189, 206/190, 163

[56] References Cited

U.S. PATENT DOCUMENTS

| | | | |
|---|---|---|---|
| 2,772,020 | 11/1956 | Kramer | 206/180 |
| 2,774,512 | 1/1956 | Dunning | 206/180 |
| 2,821,328 | 1/1958 | Ramsay | 206/180 |
| 2,881,946 | 4/1959 | Bosrock et al. | 206/180 |
| 2,942,756 | 6/1960 | Collura et al. | 206/186 |
| 2,974,827 | 3/1961 | Levkoff | 206/186 |
| 3,011,677 | 12/1961 | Struble | 206/180 |
| 3,065,876 | 11/1962 | Gioia | 206/173 |
| 3,105,608 | 10/1963 | Engel | 206/177 |
| 3,111,241 | 11/1963 | Engel | 206/180 |
| 3,198,381 | 8/1965 | Gioia | 206/176 |
| 3,411,663 | 11/1968 | Moore et al. | 206/185 |
| 3,850,292 | 11/1974 | Manizza et al. | 206/180 |

FOREIGN PATENT DOCUMENTS

| | | | |
|---|---|---|---|
| 939648 | 10/1963 | United Kingdom | 206/163 |

*Primary Examiner*—Stephen Marcus

*Attorney, Agent, or Firm*—Charles E. Brown; Charles A. Brown

[57] ABSTRACT

A multi-cellular carrier which includes a body having ends, sides, a bottom and an open top, and a divider assembly dividing the body into a plurality of cells, the divider assembly being directly integrally connected to one of the ends. The carrier is formed from a blank which includes a body forming blank portion and a divider assembly forming blank portion which are integrally joined together. When the two blank portions are longitudinally aligned, one handle panel may be carried by the divider assembly blank portion for telescoping between two handle panels carried by the body forming blank portion. On the other hand, when the two blank portions are disposed at right angles to one another so as to have an L-shape for internesting of two blanks for economy purposes, the divider assembly forming blank portion will have two handle panels. Both blanks are so constructed and configured wherein the necessary glue may be readily applied thereto and the required carrier may be readily formed by folding and gluing the blank to the flatly formed state. The flatly formed carrier may then be readily setup.

17 Claims, 3 Drawing Sheets

FIG.4
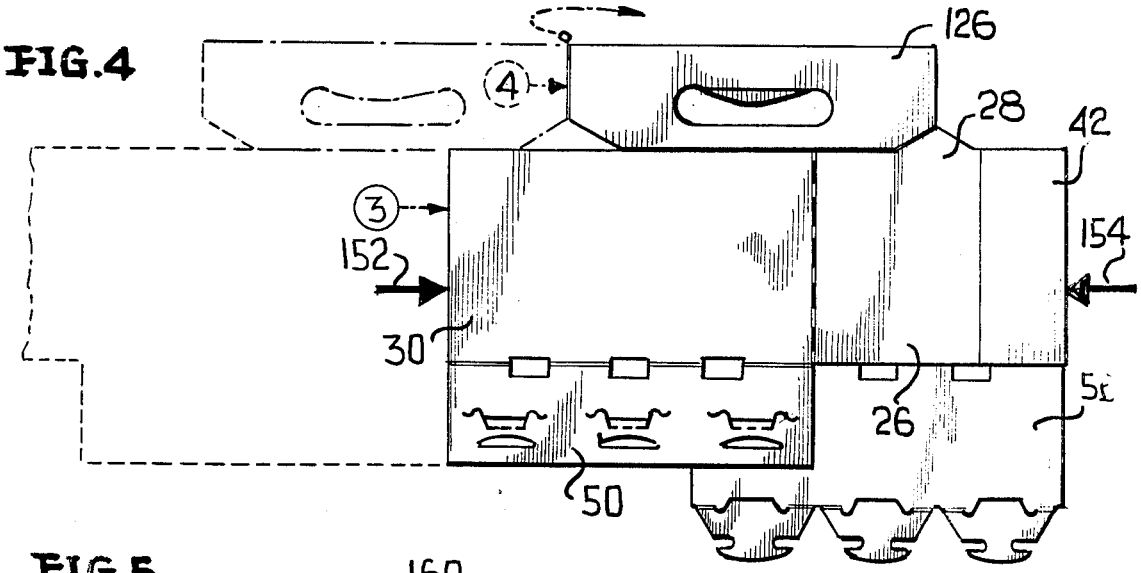
FIG.5
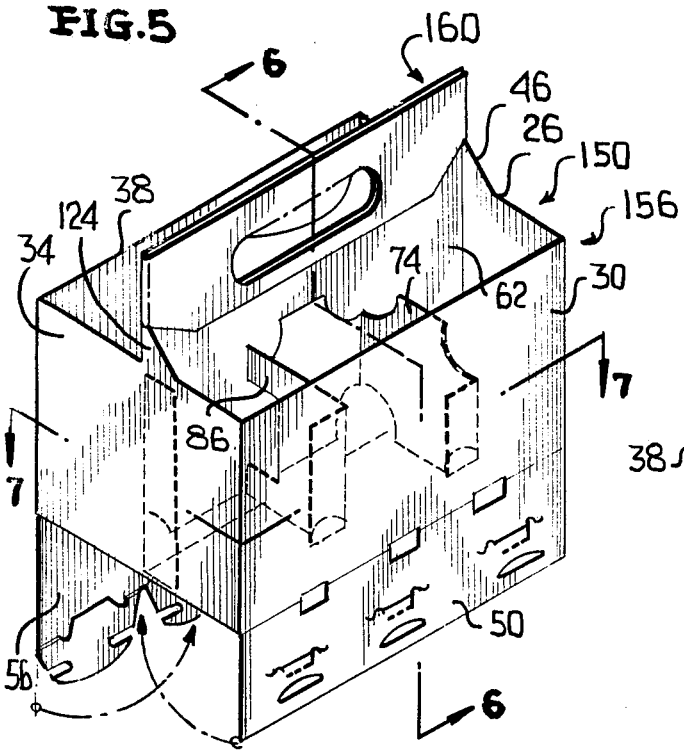
FIG.6
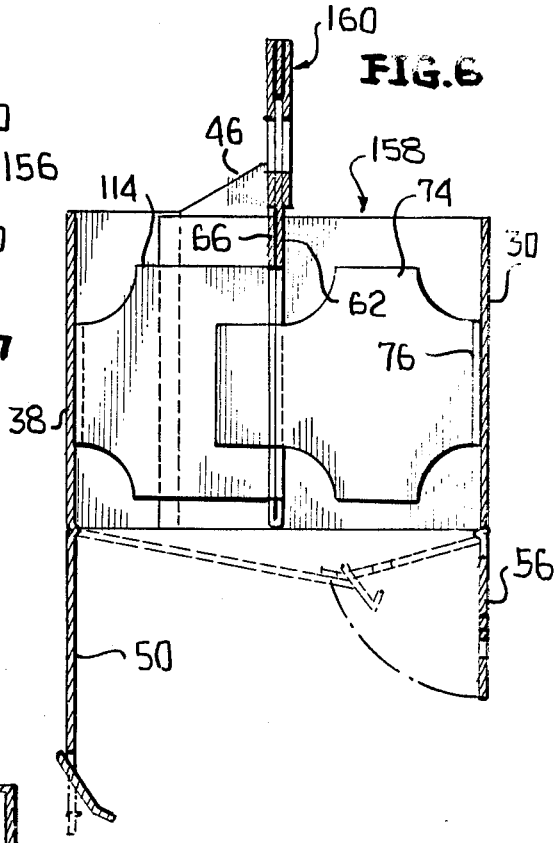
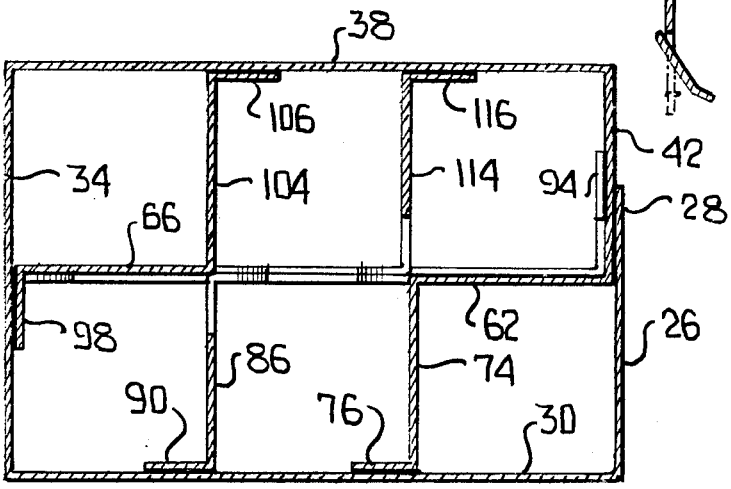
FIG.7

MULTI-CELLULAR CARRIER

This invention relates in general to new and useful improvements in cartons which may be formed from paperboard, and more particularly to a multi-cellular carrier which is formed from a one-piece blank which may be readily folded and glued to form the carrier in its flat state and which carrier may be set up for use.

Carriers of this broad type are known and a typical example is found in the patent to Manizza et al, U.S. Pat. No. 3,850,292, granted Nov. 26, 1974.

Carriers of the type to which this invention relate are generally formed of a body having ends, sides, a bottom and an open top, and a divider assembly which divides the body into a plurality of cells. In accordance with this invention, the divider assembly is directly integrally connected to one of the ends of the body. With this constructural arrangement, the carrier may be formed from a one piece blank which includes a body forming blank portion and a divider assembly forming blank portion wherein the divider assembly forming blank portion may be first readily folded and glued, after which it may be folded relative to the body forming blank portion and then the body forming blank portion may be folded and glued to form the flat carrier.

With the above and other objects in view that will hereinafter appear, the nature of the invention will be more clearly understood by reference to the following detailed description, the appended claims, and the several views illustrated in the accompanying drawings.

FIG. 4 is a plan view of the blank after the third and fourth folding operations with the blank in its final glued state ready for setup.

FIG. 5 is a top perspective view of a setup carrier with the bottom panels ready for folding to form the carrier bottom.

FIG. 6 is an enlarged transverse vertical sectional view taken generally along the line 6—6 of FIG. 5 and shows the general cross section and internal construction of the carrier.

FIG. 7 is a horizontal sectional view taken generally along the line 7—7 of FIG. 5 and shows the arrangement of the divider assembly.

Figure 1:
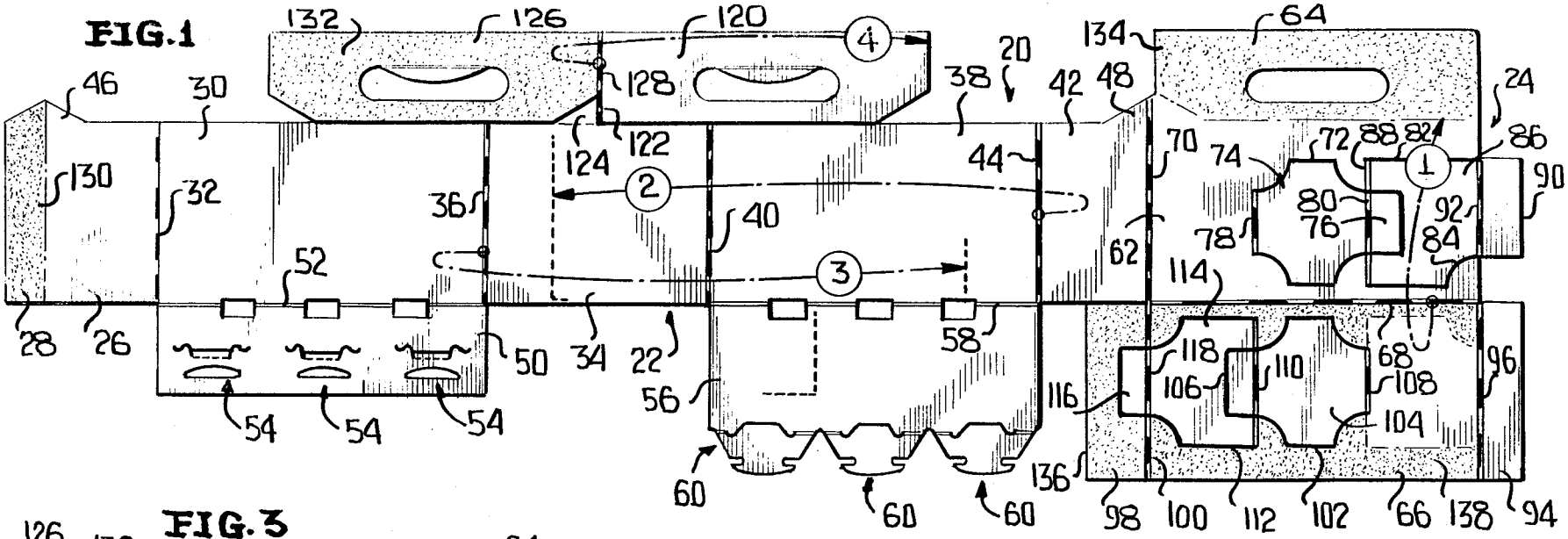
FIG. 1 is a plan view of a blank from which one form of carrier may be formed, the folding sequence of the blank being identified thereon.

Referring now to the drawings in detail, reference is first made to FIG. 1 wherein there is illustrated a blank for forming a first form of carrier in accordance with this invention, the blank being generally identified by the numeral 20. The blank 20, which will normally be formed of paperboard, is longitudinally elongated and includes a carrier body forming blank portion 22 and a divider assembly forming blank portion 24. The blank as shown in FIG. 1 is viewed from the internal surface of the blank, i.e. that surface which defines the interior of the carrier.

Starting at the left end thereof, the bottom forming blank portion 22 includes a partial end panel 26 which has at the left edge thereof a glue flap 28. One side panel 30 is connected to the right edge of the partial end panel 26 along a transverse fold line 32. An end panel 34 is connected to the right edge of the side panel 30 along a transverse fold line 36. A second side panel 38 is connected to the right edge of the end panel 34 along a transverse fold line 40. Finally, a second partial end panel 42 is connected to the right edge of the side panel 38 along a transverse fold line 44. It will be seen that the panels 26, 30, 34, 38 and 42 are in longitudinal alignment and basically are of the same width and height.

It will be seen that there is a triangular projection in the form of a near 46 extending upwardly from the upper edge of the glue flap 28 and an adjacent portion of the partial end panel 26. In addition, the partial end panel 42 has projecting upwardly from its upper edge remote from the fold line 44 a generally triangular extension 48 which corresponds to that half of the extension 46 which forms a projection of the glue flap 28.

The body forming blank portion 22 also includes an inner bottom panel 50 which is connected to a lower edge of the side panel 30 along a fold or hinge line 52. The bottom panel 50 is provided with a series of latch means 54 which in of themselves are not part of this invention.

The body forming blank portion 22 further includes an outer bottom panel 56 which is hingedly connected to a lower edge of the side panel 38 along a fold or hinge line 58. The outer bottom panel 56 is provided with a series of latch means 60 which cooperate with the latch means 54.

The divider assembly forming blank portion 24 includes a first longitudinal divider blank 62 having an upper extension in the form of a handle panel 64. A second divider panel 66 is longitudinally coextensive with the first divider panel 62 and is hingedly connected thereto along a longitudinal fold line 68.

It will be seen that the divider assembly forming blank portion 24 is directly integrally connected to the body forming blank portion 22 along a transverse fold line 70 between the partial end panel 42 and the first divider panel 62. It will be seen that the fold line 70 also extends between the right edge of the projection 48 and the adjacent handle panel 64.

A cut line 72 in the divider panel 62 defines a divider leaf 74 and a securing flap 76. The divider leaf 74 is connected to the remainder of the divider panel 62 along a transverse fold or hinge line 78 while a transverse fold or hinge line 80 joins the connecting or glue flap 76 to the divider leaf 74.

A pair of cut lines 82, 84, which extends to the right edge of the divider panel 62, defines in the divider panel 62 a second divider leaf 86 which remains connected to the divider panel 62 along an interrupted transverse fold line 88 which is aligned with the fold line 80.

At the right edge of the divider panel 62 is a glue flap 90 for the divider leaf 86 with the glue flap 90 being connected to the divider leaf 86 along a transverse fold line 92.

At the right edge of the divider flap 66 is a glue flap 94 which is joined to the divider panel 66 along a transverse fold line 96. A somewhat similar glue flap 98 is disposed at the left edge of the divider panel 66 and is joined thereto by an interrupted transverse fold line 100.

A cut line 102 in the divider panel 66 defines a divider leaf 104 and an associated glue flap 106. The divider leaf 104 remains hingedly connected to the divider panel 66 along a transverse hinge line 108 while the glue flap 106 is connected to the divider leaf 104 along a transverse fold line 110.

A further cut line 112, which is formed primarily in the divider panel 66, but which extends into the glue flap 98, defines a fourth divider leaf 114 and an associated glue flap 116. The glue flap 116 is formed entirely within the glue flap 98 and is connected to the divider leaf 114 along a transverse fold line 118 which extends between the two spaced portions of the interrupted fold line 100.

The blank 20 is completed by a second hinge panel 120 which is disposed along the upper edges of the end panel 34 and the body line 122 to an upstanding triangular projection or ear 124 of the end panel 34.

There is also a third handle panel 126 which is disposed along the upper edge of portions of the end panel 34 and the side panel 30. The handle panel 126 is connected to the handle panel 120 along a fold line 128 which is a continuation of the fold line 122.

In an initial glue application, glue 130 is applied to the glue flap 28; glue 132 is applied to the handle panel 126; glue 134 is applied to the handle panel 64; glue 136 is applied to the glue flap 98; and glue 138 is applied to the divider panel 66.

Figure 2:
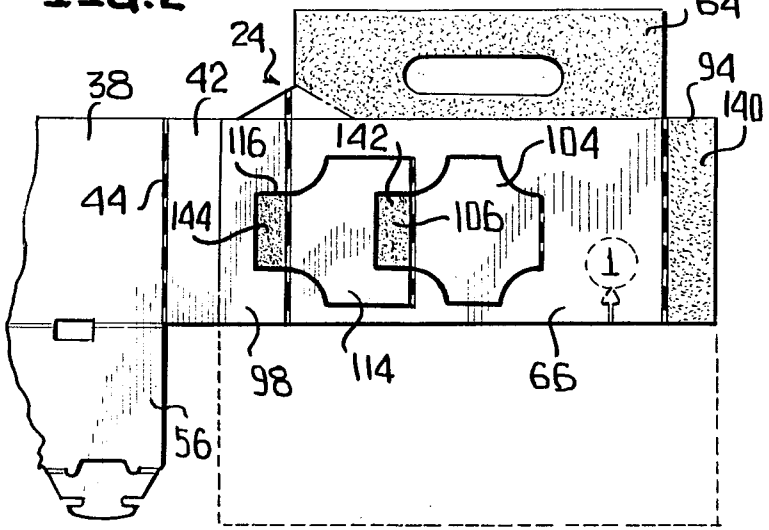
FIG. 2 is a fragmentary plan view of the blank after the first folding operation.

In a first carrier forming operation, the divider panel 66 is folded along the fold or hinge line 68 to overlie and bond to the divider panel 62. The glue flap 98 folds with the divider panel 66 to overlie and bond to the partial end panel 42. The thus partially folded blank is shown in FIG. 2.

After the first folding operation, there is a second glue or adhesive applying operation wherein glue is applied to the upper surface of the blank 20 with glue 140 being applied to the glue flap 94; glue 142 being applied to the glue flap 106; and glue 144 being applied to the glue flap 116. At the same time, glue is applied to the underside of the partially folded blank 20 to the glue flaps 76 and 90.

Figure 3:
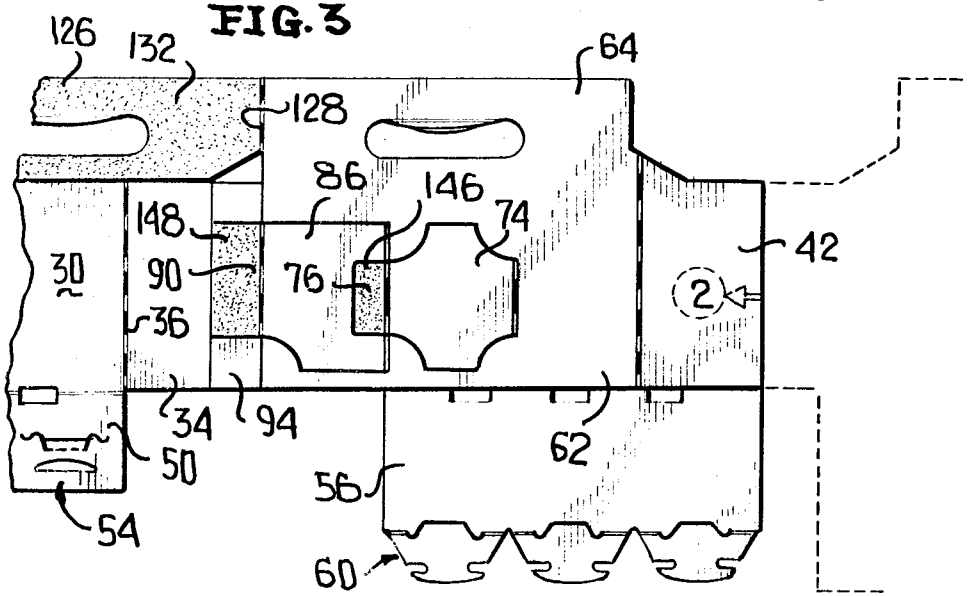
FIG. 3 is another fragmentary plan view of the blank after the second folding operation.

After this further glue application, the second folding operation is effected with the folded divider assembly forming blank portion 24 and the partial end panel 42 being folded relative to the remainder of the blank 20 along the transverse fold line 44 to the position shown in FIG. 3. At this point the handle panel 64 bonds to the handle panel 120; the glue flap 94 bonds to the end panel 34; and the glue flaps 106, 116 glue to the side panel 38.

In FIG. 3 it will be seen that in the bottom glue or adhesive application step, glue 146 is applied to the glue flap 76 and glue 148 is applied to the glue flap 90.

Next, the partial end panel 26, the glue flap 28, the side panel 30 and the bottom panel 50 are folded as a unit about the transverse fold line 36 with the glue flap 28 overlying an edge portion of the partial end panel 42 bonding the partial end panel 26 thereto. At the same time, the glue flaps 106, 116 are bonded to the side panel 30.

Finally, the handle panel 126 is folded along the fold line 128 to overlie the handle panel 64 and to bond thereto. The blank 20 is now in the form of a flat state of the carrier ready for storage and shipment and eventual setup.

When it is desired to setup or erect the carrier, which is generally shown in FIG. 5 and generally identified by the numeral 150, the opposite edges of the folded and glued blank are pressed together as indicated by the arrows 152, 154 in FIG. 4. The folded and glued blank 20 then erects to the carrier configuration of FIG. 5 with the bottom panels 50, 56 depending from the side panels 30, 38 which now form the sides of the carrier body generally identified by the numeral 156. The end panel 34 forms one end of the carrier body 156 while the glued together partial end panels 26 and 42 form the opposite end of the carrier body. The glued together divider panels 62, 66 now extend longitudinally of the carrier body 156 between the two ends thereof. The divider assembly, of which the divider panels 62, 66 and the divider leaves 74, 86, 104 and 114 form parts, is disposed within the carrier body 156 and is identified by the numeral 158. The three joined together handle panels 64, 120 and 126 now form an upstanding handle which is generally identified by the numeral 160.

The carrier 150 is completed by folding the bottom panels 50, 56 upwardly as is shown in phantom lines in FIG. 6 with the latch means 54, 60 being engaged to form a bottom of the carrier body 156.

The carrier 150 is now ready to receive bottles or like articles to form a package which may be readily handled.

It will be seen that when the divider assembly forming blank portion 24 is longitudinally aligned with the bottom forming blank portion 22, material is available for the handle panels 120, 126 without requiring any extra material. Thus, a three ply handle 160 is possible and this provides the required strength to prevent handle failure.

On the other hand, if the blank 20 were L-shaped, two blanks could be internested with a minimum of board loss. The blank 20, for example, could be modified by eliminating the handle panels 120, 126, duplicating the handle panel 64 and connecting the second handle panel 64 to the handle panel illustrated along a fold line. Then the divider panel 66 rotated 180°, could be attached to the second handle panel 64 along a fold line corresponding generally to the fold line 68.

Figures 8, 9, 10:
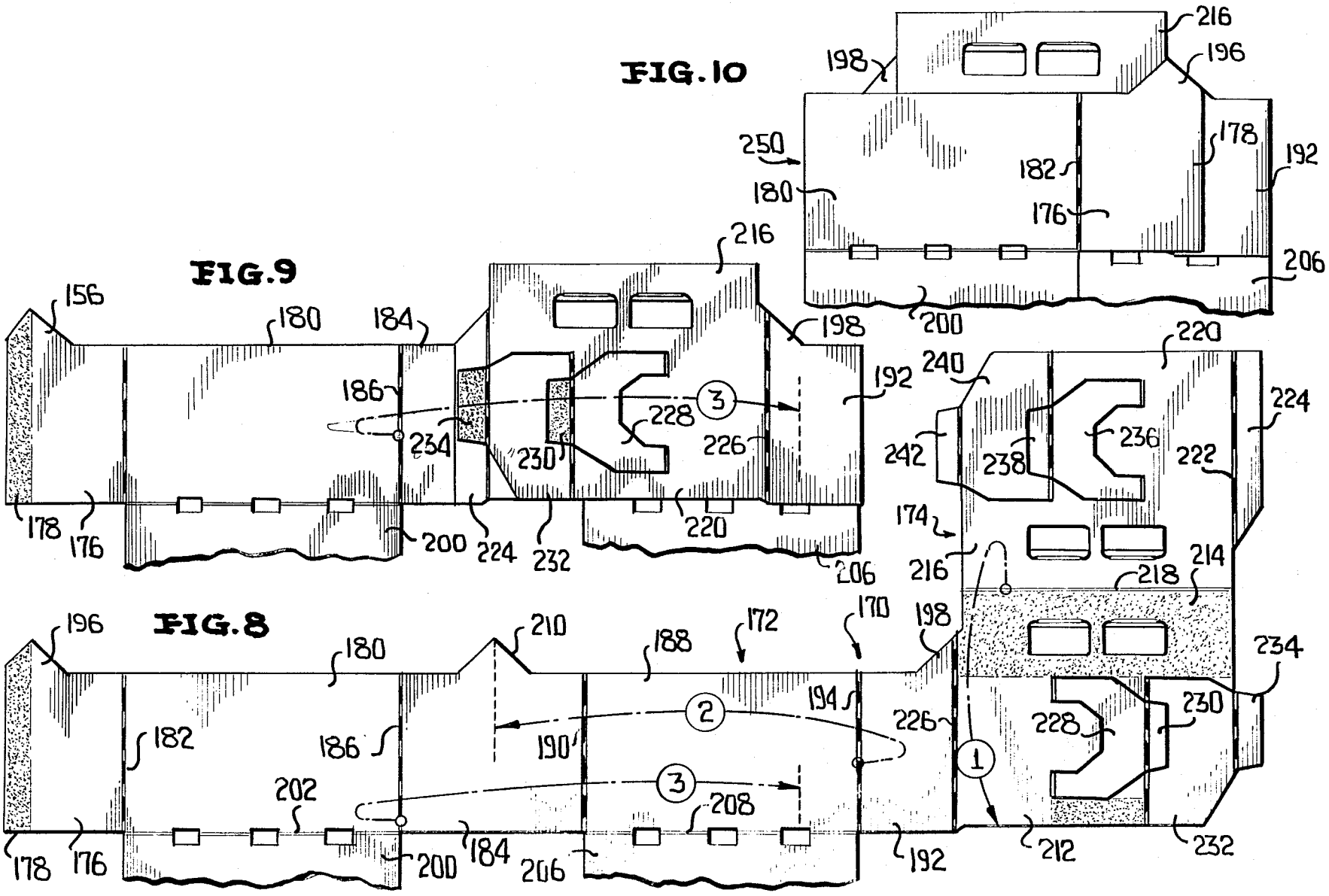
FIG. 8 is a plan view similar to FIG. 1 of a blank for a modified form of carrier having folding sequence identifying indicia thereon.
FIG. 9 is a fragmentary plan view of the blank of FIG. 8 after the first and second folding and gluing sequences.
FIG. 10 is a fragmentary plan view of the blank after the third and final folding and gluing sequence showing the carrier in its flat state ready for setup.

With respect to the provision of a L-shaped blank, reference is now made to FIG. 8 wherein there is illustrated an L-shaped blank 170. This blank, although slightly different from the blank 20 clearly incorporates the L-shaped arrangement described hereinabove relative to the blank 20.

The blank 170, like the blank 20, includes a body forming blank portion 172 and a divider assembly forming blank portion 174, the blank portion 174 being disposed at right angles to the blank portion 172 as described hereinabove.

The body forming blank portion 172, with the exception of the absence of the handle panels 120, 126 and a modification of the projection or ear 124 will be identical to that of the bottom forming blank portion 22. It includes at one end a partial end panel 176 which carries a glue flap 178. A side panel 180 is connected to the partial end panel 176 along a transverse fold line 182. In a like manner, an end panel 184 is connected to the right edge of the side panel 180 along a transverse fold line 186.

A second side panel 188 is connected to the right edge of the end panel 184 along another transverse fold line 190. Finally, a partial end panel 192 is connected to the right edge of the side panel 188 along a transverse fold line 194.

At their upper edges, the partial end panel 176 and the glue flap 178 are provided with a triangular projection 196. At the right upper edge of the partial end panel 192 there is also a triangular projection or ear 198.

An inner bottom panel 200, which corresponds to the bottom panel 50, is hingedly connected to the lower edge of the side panel 180 along a longitudinal fold line 202. In a like manner, an outer bottom panel 206, which corresponds to the bottom panel 56, is hingedly connected to the lower edge of the side panel 188 along a longitudinal fold line 208.

The body forming blank portion 172 is completed by a centrally located upstanding triangular projection 210 which extends upwardly from the upper edge of the end panel 184.

The divider assembly forming blank portion 174 includes a first divider panel 212 which corresponds to the divider panel 62. A first handle panel 214 is formed integrally with the upper edge of the divider panel 212. A second handle panel 216 is connected to the upper edge of the handle panel 214 along a longitudinal fold line 218. A second divider panel 220 is formed as an integral upper extension of the handle panel 216. The divider panel 220 has hingedly connected to the right edge thereof along a transverse fold line 222 a glue flap 224.

The entire divider assembly forming blank portion 174 is hingedly connected to the right edge of the body forming blank portion 172 along a transverse fold line 226 which in part extends between the partial end panel 192 and the divider panel 212 and in part between the projection 198 and the handle panel 214.

The divider panel 212 is provided with suitable cut and fold lines to define a first divider leaf 228 having a glue flap 230. The right hand end portion of the divider flap 212 is in the form of a second divider leaf 232 having a projecting glue flap 234.

The divider panel 220 is generally of a reverse construction to that of the divider panel 212 and is provided with cut and fold lines to define a third divider leaf 236 having a glue flap 238. The left hand part of the divider panel 220 defines a fourth divider leaf 240 having a glue flap 242.

It will be readily apparent from FIG. 8 that a second blank 170, rotated 180° from the blank of FIG. 8, will generally internest with the blank 170 so that board having a width equal to the width of the blank 170 may be utilized with a minimal loss.

The blank 170 has glue applied thereto in the same manner as that described with respect to the blank 20 and as is generally shown in FIG. 8, after which the divider assembly forming blank portion 174 is folded along the fold line 218 so that the divider panels 212, 220 are glued together and the handle panels 214, 216 are glued together. Thereafter glue is applied to the glue flaps 230, 234, 238 and 242 on the appropriate sides.

Next the partially folded blank 170 is folded along the transverse fold line 194 to the position shown in FIG. 9 wherein the glue flaps 238, 242 are bonded to the side panel 188. At the same time, the glue flap 224, which has glue applied thereto, is bonded to the end panel 184.

Then the left hand portion of the body forming blank portion 172 is folded to the right along the transverse fold line 186 so that the side panel 180 overlies the divider panel 220. At this time the glue flaps 230, 234 bond to the side panel 180 and the glue flap 178 bonds to the partial end panel 192. A resultant flatly folded, ready to setup, carrier, generally identified by the numeral 250 is shown in FIG. 10. The carrier 250 will be setup in the same manner as shown in FIGS. 4–6 with respect to the carrier 150 with the divider assembly formed from the divider assembly forming blank portion 174 dividing the interior of the body of the resultant carrier into a plurality of cells as is generally shown in FIG. 7.

It will be apparent from the foregoing that when the two blank portions are longitudinally aligned as shown in FIG. 1, sufficient material is available so that the handle of the resultant carrier may be of a three ply construction for the added strength. On the other hand, when the blank portions are disposed at right angles to one another to provide for a generally L-shaped blank, then, while there is a savings of material as compared to the blank of FIG. 1, as is shown in FIG. 8, there is only sufficient material for two handle layers or panels. However, by making the carrier body from one blank portion and the divider assembly from a second blank portion at the end of the first blank portion, a maximum economy of material may be obtained while in no way reducing the strength of the resultant carrier.

Although only several forms of the carrier have been specifically illustrated and described herein, it is to be understood that minor variations may be made in the carrier and the blank from which it is formed without departing from the spirit and scope of the invention as defined by the appended claims.

I claim:

1. A blank for forming a multicellular carrier of the type including an upwardly open body and a divider assembly, said blank comprising a body forming blank portion and a divider assembly forming blank portion, said blank portions being integrally directly joined together, said body forming blank portion including joined together body panels arranged in longitudinal relation by transverse connections, said divider assembly forming blank portion forming a transverse extension of said body forming blank portion, said divider assembly forming blank portion including two divider panels connected together by a first longitudinal connection, each of said divider panels having divider leaves adapted to be struck from said divider panels and secured to adjacent body panels, and a first handle panel connected to one of said divider panels along a second longitudinal connection, and said body forming blank portion carrying second and third handle panels in longitudinal alignment with said first handle panel.

2. A blank according to claim 1 wherein said two divider panels are separated by two intervening handle panels forming portions of said first longitudinal connection.

3. A blank for forming a multi-cellular carrier of the type including an upwardly open body and a divider assembly, said blank comprising a body forming blank portion and a divider assembly forming blank portion, said blank portions being integrally directly joined together, said body forming blank portion including joined together body panels arranged in longitudinal relation by transverse connections, said divider assembly forming blank portion forming a transverse extension of said body forming blank portion, said divider assembly forming blank portion including two divider panels connected together by a first longitudinal connection, each of said divider panels having divider leaves adapted to be struck from said divider panels and secured to adjacent body panels, and a first handle panel connected to one of said divider panels along a second longitudinal connection, said divider assembly being connected to a single one of said body panels along a transverse connection, said one body panel having a projecting ear, and said handle panel being connected to said ear along a transverse connection aligned with the first mentioned transverse connection.

4. A blank according to claim 3 wherein said blank is L-shaped.

5. A blank according to claim 3 wherein said two divider panels are directly integrally connected together along a longitudinal fold line forming said first longitudinal connection.

6. A multi-cellular carrier comprising a body having ends, sides, a bottom, and an open top, and a divider assembly dividing said body into a plurality of cells, said divider assembly being directly integrally connected to one of said ends, said divider assembly including a pair of longitudinal divider panels extending between said ends, and a plurality of transverse divider leaves struck from each of said divider panels and connected to a respective one of said sides, a handle panel directly integrally connected to each of said divider panels, said handle panels being solely and directly hingedly connected together, one of said divider panels being integrally connected solely to one of said handle panels and said handle panel being directly hinged to an upstanding ear formed on said one end.

7. A multi-cellular carrier comprising a body having ends, sides, a bottom, and an open top, and a divider assembly dividing said body into a plurality of cells, said divider assembly being directly integrally connected to one of said ends, said divider assembly including a pair of longitudinal divider panels extending between said ends, and a plurality of transverse divider leaves struck from each of said divider panels and connected to a respective one of said sides, a handle panel directly integrally connected to each of said divider panels, said handle panels being solely and directly hingedly connected together, one of said divider panels being integrally connected solely to one of said handle panels and the other of said divider panels and an associated one of said handle panels being hingedly connected to said one end with said one end having an upstanding ear and said associated one handle panel being hingedly connected to said ear.

8. A multi-cellular carrier comprising a body having ends, sides, a bottom, and an open top, and a divider assembly dividing said body into a plurality of cells, said divider assembly being directly integrally connected to one of said ends, said divider assembly including a pair of longitudinal divider panels extending between said ends, and a plurality of transverse divider leaves struck from each of said divider panels and connected to a respective one of said sides, one of said divider panels being directly integrally connected to said one end along an upstanding fold line, an integral handle panel extending upwardly from said one divider panel, said one end having an upstanding ear, and said handle panel being hingedly connected to said ear along an extension of said upstanding fold line.

9. A carrier according to claim 8 wherein the other of said divider panels also has a handle panel extending upwardly therefrom.

10. A carrier according to claim 8 wherein the other of said divider panels also has a handle panel extending upwardly therefrom, and said handle panels are connected together along a fold line at the upper edges thereof.

11. A carrier according to claim 10 wherein said handles form the connection between said divider panels.

12. A carrier according to claim 8 wherein said divider panels are directly connected together along a lower horizontal fold line.

13. A carrier according to claim 8 wherein there is a further handle panel integrally permanently connected to a second of said ends and disposed in overlapping aligned relation with the first mentioned handle panel.

14. A carrier according to claim 13 wherein the connection between said further handle panel and said second end includes an ear projecting upwardly from said second end.

15. A carrier according to claim 13 wherein a third handle panel is directly integrally connected solely to said further handle panel.

16. A carrier according to claim 15 wherein the connections between said further handle panel and said second end and said third handle panel are vertically aligned hinge connections.

17. A carrier according to claim 13 wherein a third handle panel is directly integrally connected solely to said further handle panel, and the first mentioned handle panel is positioned between said further handle panel and said third handle panel.

* * * * *